US005482341A

United States Patent [19]

Schmitz, Jr.

[11] Patent Number: 5,482,341

[45] Date of Patent: Jan. 9, 1996

[54] APPARATUS FOR LIFTING STORAGE TANKS AND THE LIKE

[76] Inventor: John W. Schmitz, Jr., 382 Prince Frederick St., King of Prussia, Pa. 19406

[21] Appl. No.: 275,028

[22] Filed: Jul. 14, 1994

[51] Int. Cl.[6] ..... B66C 1/66

[52] U.S. Cl. ..... 294/93; 294/97

[58] Field of Search ..... 294/67.1, 67.3, 294/67.31, 82.1, 82.11, 82.24, 82.31, 89, 93, 95, 97, 153, 156, 170, 171

[56] References Cited

U.S. PATENT DOCUMENTS

| | | | |
|---|---|---|---|
| 1,890,734 | 12/1932 | Kuberka | 294/97 X |
| 2,584,124 | 2/1952 | Gustafson | 294/93 X |
| 3,307,871 | 3/1967 | Russell et al. | 294/97 X |
| 3,385,627 | 5/1968 | Zumbo | 294/93 |
| 3,583,753 | 6/1971 | McCrory | 294/97 X |
| 3,636,594 | 1/1972 | Faivre | 294/170 X |
| 4,838,595 | 6/1989 | Spillar | 294/97 X |

FOREIGN PATENT DOCUMENTS

| | | | |
|---|---|---|---|
| 626014 | 9/1978 | U.S.S.R. | 294/97 |

*Primary Examiner*—Dean Kramer
*Attorney, Agent, or Firm*—Synnestvedt & Lechner

[57] ABSTRACT

An apparatus is disclosed which is used to assist in lifting and moving storage tanks, pipes and the like. The apparatus includes a tubularly-shaped body suspended from a cable, the tubularly shaped body having a slot which communicates with the hollow interior of the tube allowing the cable to radially enter and exit approximately one-half of the hollow interior of the tube. The tube is inserted into an access port in the tank to be lifted and is positioned to engage the interior of the tank. The interaction of the slotted tube with the cable provides a convenient tool for engaging, securing and lifting the tank.

20 Claims, 6 Drawing Sheets

PIPE HOOK (PRIOR ART)

APPARATUS FOR LIFTING STORAGE TANKS AND THE LIKE

FIELD OF THE INVENTION

This invention relates generally to an apparatus to assist in lifting objects and more specifically to an apparatus for lifting storage tanks having an access port.

BACKGROUND OF THE INVENTION

Storage tanks are used to contain and store a variety of materials, including water, gasoline, oil, etc. Storage tanks are commonly buried under ground for aesthetic and safety reasons. The first step in the installation of a storage tank is to choose an appropriate site. The ground is excavated to accommodate the dimensions of the tank and to meet various regulations regarding the burial of the tank. Usually, a chain or a metal strap is placed under each end of the tank. The straps are then connected to a crane or other piece of equipment capable of lifting the tank. The tank is placed into the hole and the metal bands are removed from beneath the tank.

Eventually, the tank will have to be removed from the ground. Environmental factors take their toll on buried objects. Over time, the integrity of the storage tanks are compromised and their contents leak out, necessitating the removal of the tank. Remodeling or a change in requirements may also precipitate the removal of a buried tank.

The extraction of storage tanks from the ground can be a lengthy and expensive process. First, the tank is usually drained. Next, the ground around the tank is completely excavated. This is usually a tedious and/or dangerous process if there is a high water table, flooding or if hazardous materials have leaked into the ground. A worker must thread a chain or a metal band under each end of the tank. The chains or bands are then connected to a crane or a backhoe equipped with lifting hooks. Care must be taken in order to ensure that the tank is substantially centered between the metal bands, otherwise, the tank will tilt and only one end of the tank will be lifted out of the ground. Consequently, the metal bands will slide off of the tank. It would be difficult to slip the chains under the tank again since the tank may no longer be in a substantially horizontal position.

Some storage tanks have a manway located on the top of the tank which allows a person to access the interior of the tank. In this style of tank, an alternative method may be used to lift the tank. A loop is formed at the end of a cable or chain. This is done by bolting or clamping the end of a cable or chain onto itself as shown in FIG. 1. A worker must climb down into the tank. The loop is lowered into the manway or into another access port. The person inside the tank must insert a curb pin through the loop. A crane is attached to the free end of the chain for lifting the tank. The person inside the tank may have to hold the curb pin until the slack in the cable is taken up, i.e., until the curb pin is raised high enough to engage the tank wall and is properly oriented. In this manner, the weight of the tank prevents the curb pin from slipping out of the loop.

A loop and curb pin combination may similarly be used to lift sections of a piping system. Many piping systems include predetermined lengths of pipe and various fittings (manhole, meter, valve, access, etc.) The use of a loop/curb pin in a fitting having an access port is similar to its use in a tank. In order to lift sections of pipe, a drill is used to cut an appropriate hole into the pipe to accommodate the loop/curb pin. In addition, an apparatus known as a pipe hook is also used to lift pipe (see FIG. 2). Two pipe hooks are usually required to lift the pipe; one at each end of the pipe. Consequently, two people, one at each hook, are usually needed to steady the pipe hooks until the crane takes up the slack in the cable.

The above methods require access to the interior of the tank or pipe. Further, they are labor intensive. Accordingly, previous methods of lifting tanks and pipes are expensive and dangerous. Injuries to fingers are not uncommon since the curb pin or pipe hook must be held in place by hand in order to attain the proper orientation. Also, the cost of providing protective gear for employees who must climb into a tank which previously held hazardous materials can be quite high.

SUMMARY OF THE INVENTION

An object of the present invention is to provide an improved apparatus for removing storage tanks and similar objects from the ground.

The instant invention includes a substantially tubularly-shaped body, having a radial slot communicating with the hollow interior of the body. The slot extends from a first end of the body toward the second end of the body to a point substantially in the lengthwise mid-region of the body, i.e., midway down the axis of the tubular body. A cable is threaded through the hollow interior of the body. At the end of the cable closer to the second end of the body, a means is attached to prevent the cable end from sliding back through the hollow interior of the body. The body is weighted so that when the body is suspended by the cable, i.e., it is in its rest position, the body has a generally vertical orientation with the first end of the body situated at a higher elevation than the second end, with the cable nestled within the slot.

One embodiment utilizes a V-shaped hollow interior. The V-shaped interior is in the same plane as the slot, with its vertex extending away from the slot. The V-shaped interior prevents axial rotation about the cable, assists in keeping the tubular body in a vertical resting position, and provides a larger thickness of metal against which the cable pulls when lifting objects.

DETAILED DESCRIPTION OF THE PREFERRED EMBODIMENT

Figure 2:
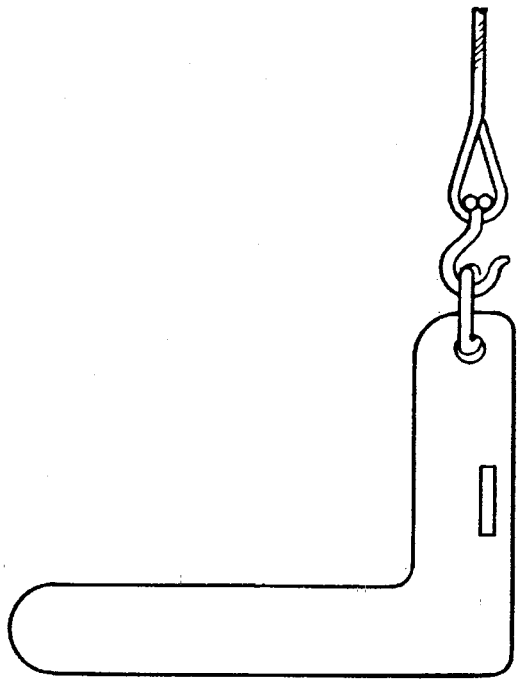
FIG. 2 is a perspective view of a prior art pipe hook device used for lifting pipes.
Figure 1:
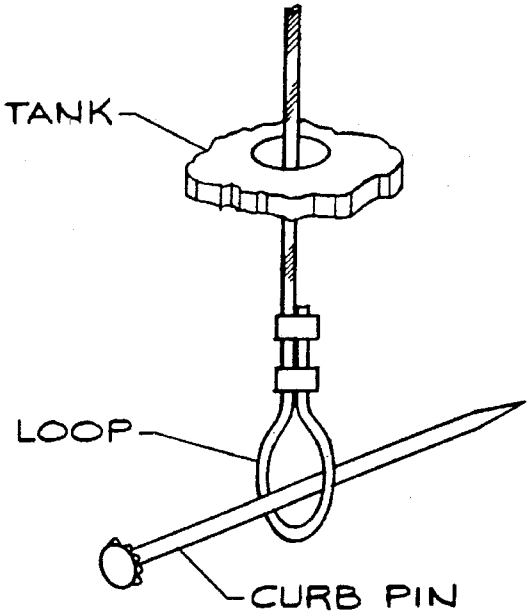
(PRIOR ART) FIG. 1
FIG. 1 is a perspective view of a prior art loop and curb pin device used for lifting tanks and pipes.
Figure 3:
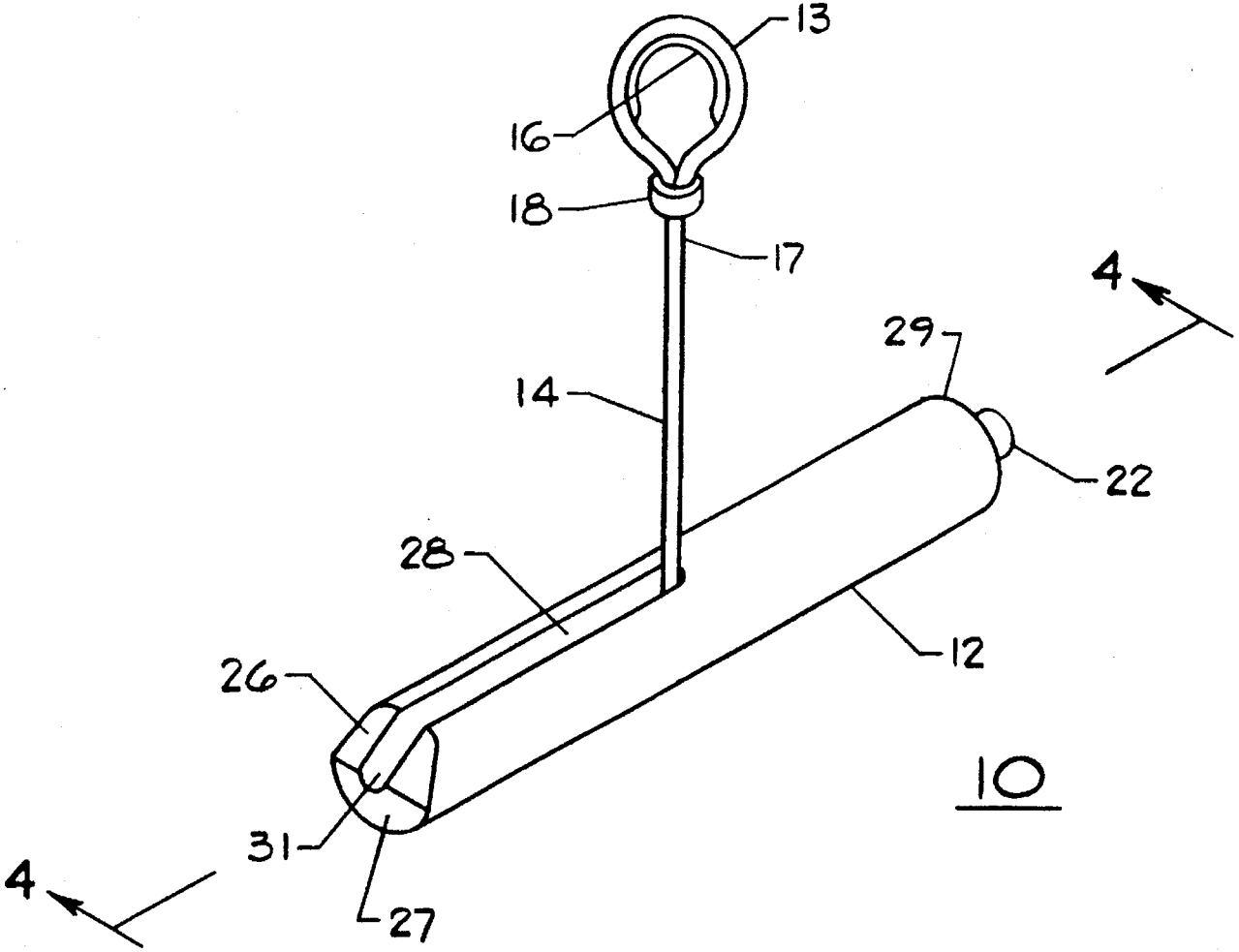
FIG. 3 is a perspective view of a lifting apparatus in accordance with the present invention.
Figure 4C:
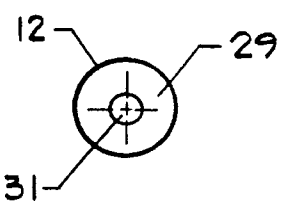
FIG. 4C is a second end view of the present invention taken along line 4C—4C of FIG. 4A, also before the cable is threaded through the hollow tubular section of the body.
Figure 4A:
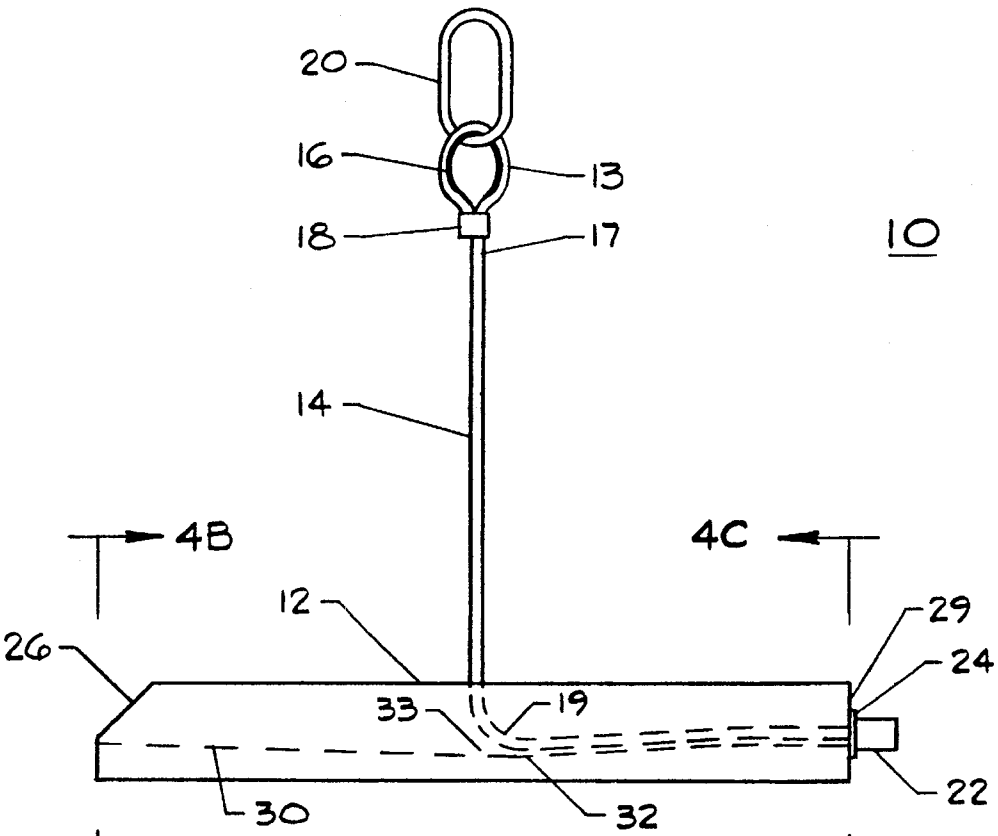
FIG. 4A is a side view of the present invention taken along line 4—4 of, and on a larger scale than, FIG. 3.

Referring to the drawings, an improved device for lifting and moving objects is designated generally as 10. A substantially tubular body 12 coacts with a cable or chain 14, as shown in FIGS. 3 and 4A. The tubular body 12 is prevented from sliding off of cable 14 by button 22, which is clamped onto an end of cable 14. When body 12 is suspended by chain 14, its normal or resting position is substantially vertical. However, it is convenient to show all of the elements of the device while in a T-position. (The T-position is the lifting position as will become evident after a reading of this specification.)

The type of material used and the diameters of the body 12 and cable 14 depend on the weight of the storage tank or other object to be lifted. In the preferred embodiment, the body 12 and cable 14 are made of steel.

Figure 4B:
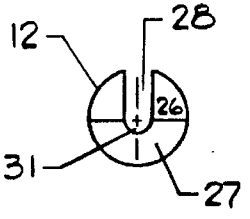
FIG. 4B is a first end view of the present invention taken along line 4B—4B of FIG. 4A showing the beveled area and the slot, before the cable is threaded through the hollow interior of the body.

FIG. 4B is a view of a first end 27 of the tubular body 12 taken along line 4B—4B of FIG. 4A; FIG. 4C is a view of the tubular body 12 taken along line 4C—4C of FIG. 4A. In the interest of clarity, FIGS. 4B and 4C are depicted before the cable has been attached.

Tubular body 12 includes a passageway or hollow interior 31 running the length of the tube. A radial slot 28, having a length approximately one-half of the length of the tube 12 starting from a first end 27 of tubular body 12 and extending longitudinally to approximately the middle of the tube 12, communicates with the hollow portion 31. The diameters of the hollow portion 31 and the slot 28 must be of sufficient size to accommodate the diameter of cable 14.

Cable 14 is threaded through hollow portion 31 of tube 12. The button 22, or a similar stop means, is connected to the cable 14 at the point it emerges from second end 29 of tube 12 and prevents the end of cable 14 from slipping back through the hollow interior 31 of tube 12. A washer 24 may be used to help distribute the pressure over the second end 29 of tube 12. The button 22 is not connected to tubular body 12; therefore, tubular body 12 can freely slide up and down the length of cable 14. The free end 17 of cable 14, opposite the button 22, is attached to a lift ring 20. The preferred attachment method is to form a loop 13 with the free end 17 of cable 14. The loop 13 is formed by wrapping the cable 14 around a thimble 16, and securing the end of the cable with a swedge or swage block 18.

Referring again to FIG. 4A, in the preferred embodiment, the hollow interior 31 is not perfectly concentric with the axis of the tube 12. The hollow portion 31 consists of two sloping or tapering legs 30 and 32 which generally form the shape of a "V" or chevron. The base or vertex 33 of the "V" is located approximately at the middle of the tube 12. The tapered legs 30,32 are planar to the slot 28, with the vertex 33 located at a point furthest from the slot 28. This design helps to keep the tube body 12 in a vertical position, substantially parallel to the cable 14, when the tube body 12 is suspended from the cable 14 (its resting position). The V-shaped passageway also resists axial rotation of the body 12 about cable 14, i.e., rotation about the tube's longitudinal axis. Finally, this V-shaped design reduces manufacturing costs, as will become evident after reading the entire disclosure.

Figure 5A:
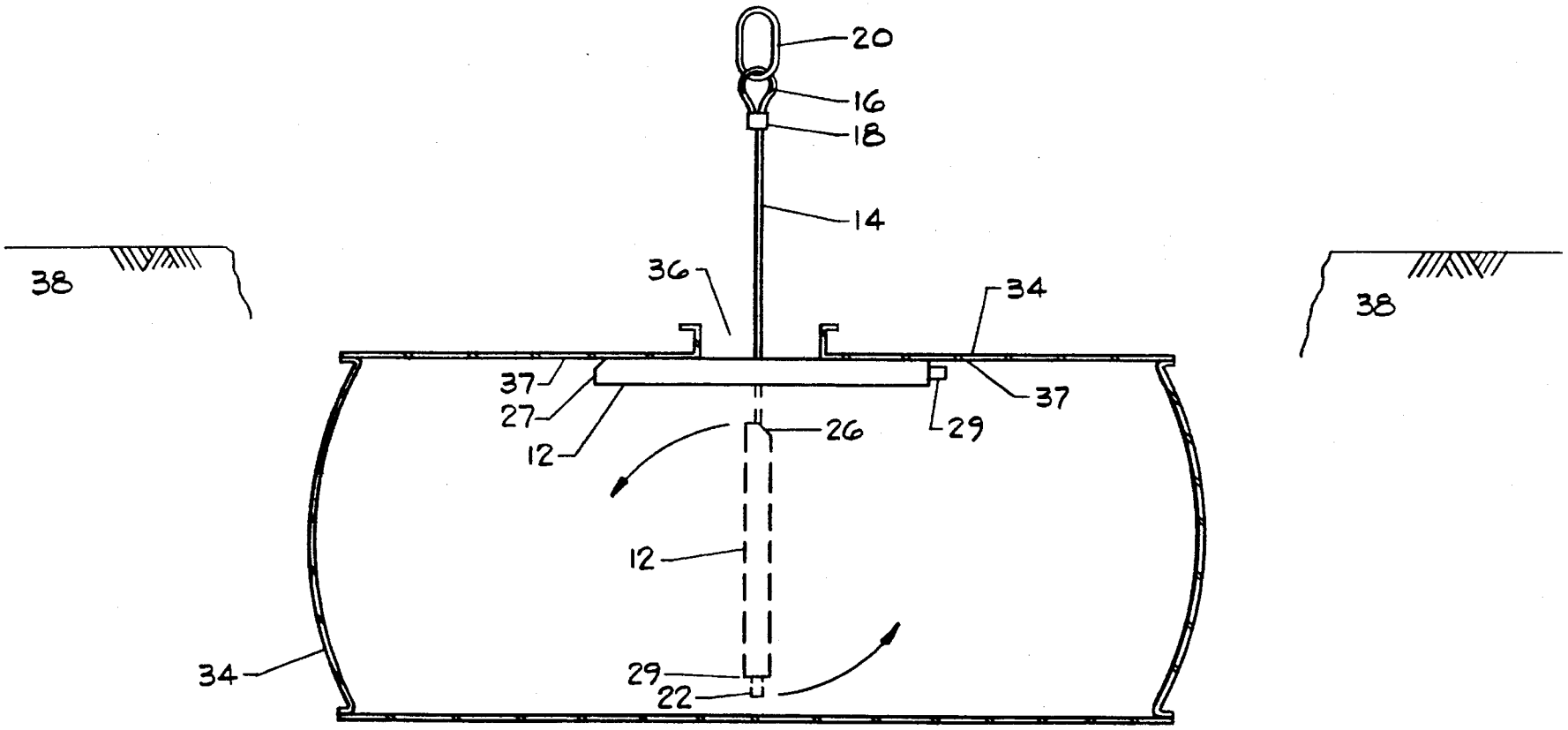
FIG. 5A is a side elevational view showing (in dashed limes) the present invention in its vertical resting position after it is inserted into a storage tank, and (in solid lines) after the invention has assumed its lifting or "T" position.
Figure 5B:
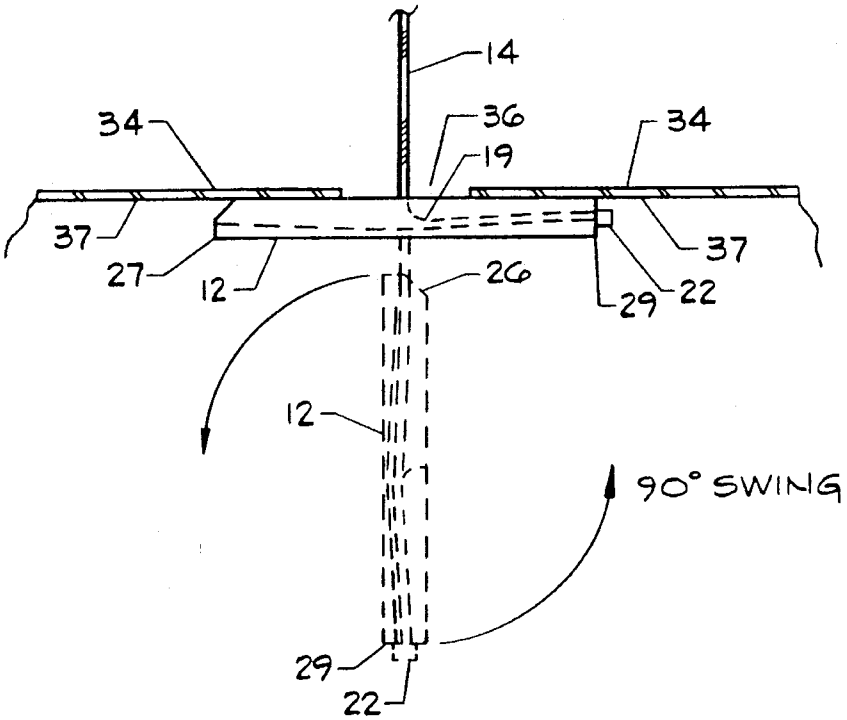
FIG. 5B is an enlarged side elevational view of the lifting apparatus shown in FIG. 5A.

Referring now to FIGS. 5A and 5B, a use of the instant invention will be discussed. The apparatus 10 can be used to lift a variety of heavy objects, including storage tanks, septic tanks, pipes, fittings used in piping systems and other objects that have an access or vent portal. Tank 34 is submerged under the ground 38. Normally, the dirt is excavated to expose approximately the upper half of the tank. The entire tank need not be dug out of the ground. One of the various access ports 36 (bung hole, vent hole, fill hole, manway, etc.) of tank 34 is opened and the apparatus 10 is inserted. If the weight of the tank does not exceed the design specifications of the apparatus 10, only one apparatus 10 will be required. In this case, it is preferred that the apparatus 10 be placed in an access port near the center of the tank.

The tube 12 is weighted so that when it is suspended from cable 14, its resting state is a substantially vertical orientation. This allows the apparatus 10 to easily enter into the access portal 36. The combination of the weighting of tube 12 and the V-shaped sloping legs 30, 32 keeps the center of gravity of tube 12 substantially at a point along cable 14. The cable 14 is nestled within the slot 28, and tube 12 remains in a vertical orientation, substantially concentric with the cable 14. Therefore, a person is not required to stand on, or in, tank 34 to guide the apparatus 10 through access port 36.

Figure 6:
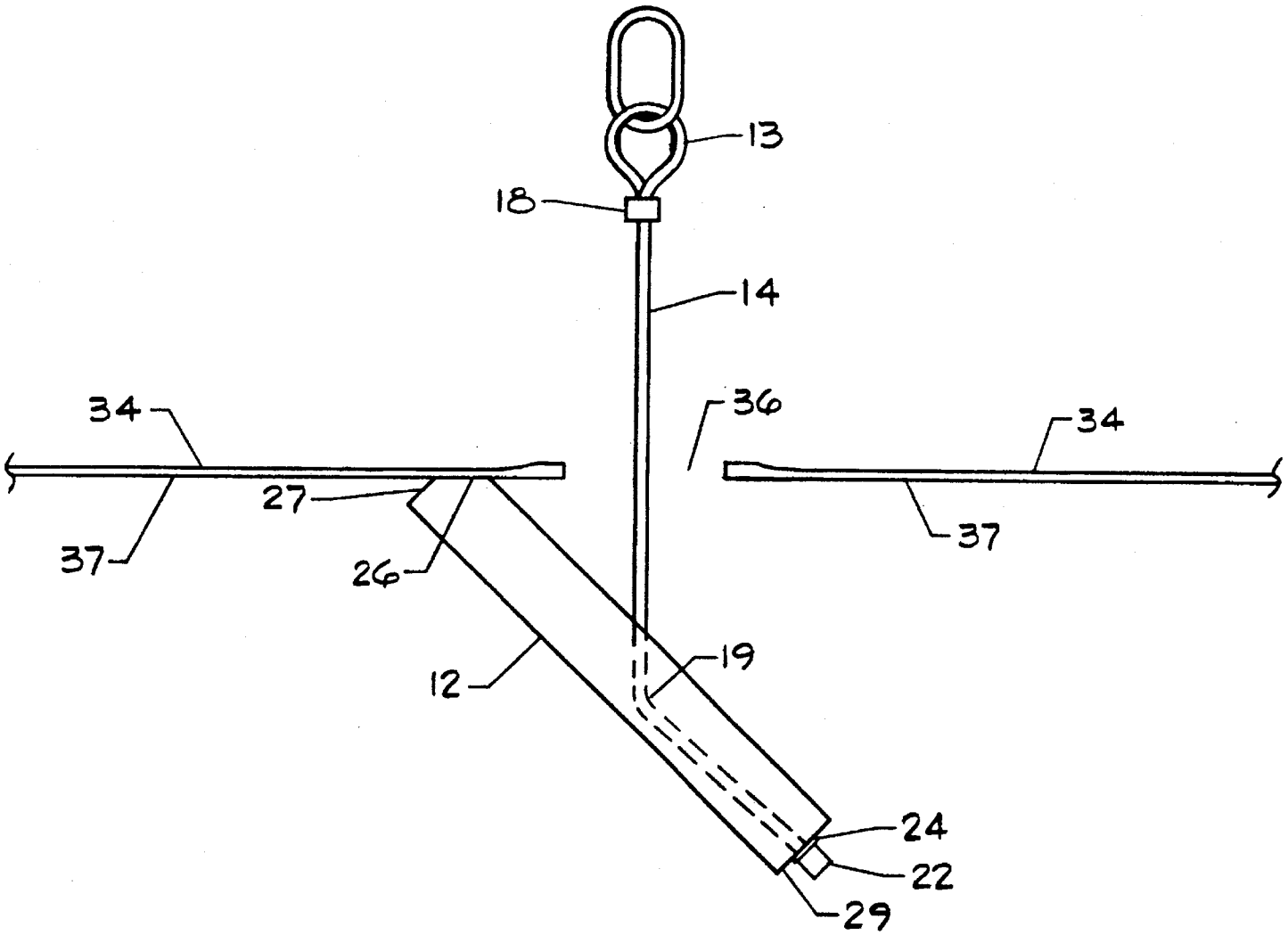
FIG. 6 is a side view of the instant invention as the first end engages the inner surface of the tank wall to initiate the rotation of the tubular body toward its lifting position.

When tube 12 has been fully inserted into the interior of tank 34, the cable 14 is positioned to physically contact a side of access port 36. The cable 14 is then activated in the direction toward withdrawal of the cable 14 from tank 34. As the withdrawal of cable 14 takes place, first end 27 engages the interior of the upper wall 37 of tank 34 (see FIG. 6), and tube 12 begins to pitch or pivot about a cable contact point 19. The cable contact point 19 is located on a transverse axis perpendicular to the plane defined by the slot 28 and is the point at which cable 14 physically contacts tube 12 as it exits the hollow passageway 31.

After the edge of first end 27 makes initial contact, a beveled edge 26 at first end 27 engages the interior wall 37, allowing the first end 27 of tube 12 to slide more easily along the interior wall 37 of tank 34. As cable 14 continues to be withdrawn from the tank, cable 14 separates from leg 30 and exits the hollow portion 31 of tube 12 via the slot 28. Tube 12 coacts with cable 14 by continuing to pivot about contact point 19 until tube 12 rotates substantially ninety degrees, and nearly the entire length of tube 12 contacts the interior wall 37. Tube 12 is now in a horizontal position substantially perpendicular to cable 14, i.e., its lifting or "T" position, with the slot 28 facing generally upwards. The tube 12 will remain in this "T" position as long as tension or force is applied to free end 17 of cable 14.

Beveled edge 26 can be designed to meet a particular requirement. However, for use in many applications, the plane of the cut is perpendicular to the plane defined by slot 28 and at a forty-five degree angle to the longitudinal axis of tube 12.

Note that tube 12 bridges the opening of access port 36. The length of tube 12 is determined by the diameter of access port 36. The length of tube 12 must be greater than the diameter of the access port 36.

It is preferred to orient the tube 12 generally parallel to the length of tank 34, as shown in FIG. 5A. This position distributes the weight of the tank across a larger surface area of tube 12, preventing the deformation of the tank 34. Also, this orientation with respect to the tank 34 allows the beveled edge 26 to more easily slide along the interior wall 37 of the tank 34.

It should be noted that the tapered legs 30, 32 of the tube 12 effectively increases the thickness of the metal of tube 12 at contact point 19. Therefore, as the apparatus 10 is lifting a tank out of the ground, there is less of a chance of the cable ripping through the exterior of the tube 12. The V-shaped hollow interior 31 allows a smaller diameter tube 12 to be used to lift a specified weight, thereby reducing manufacturing costs since less material is needed to produce tube 12. For example, if the hollow passageway 31 were concentric with the longitudinal axis of tube 12, a tube diameter of approximately five inches may be required to lift a certain size tank. However, the sloping legs 30, 32 provide a larger thickness of metal at the contact point 19 allowing the overall diameter of the tube 12 to be approximately three and one-quarter inches to lift the identical tank.

Figure 7:
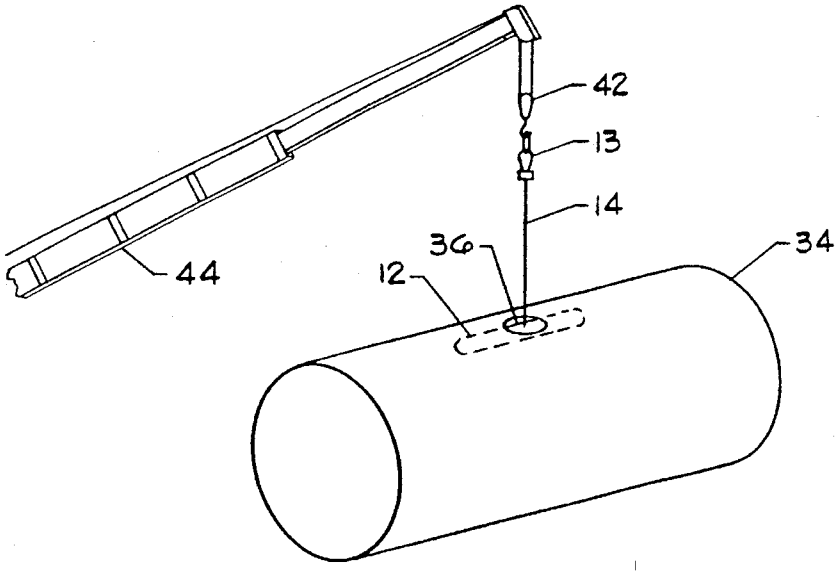
FIG. 7 is a perspective view of a tank being lifted by a crane using the instant invention.

As can be seen in FIG. 7, the lifting ring 20 can be connected to a hook 42 of crane 44 or a similar piece of machinery used for heavy lifting duties. As the crane 44 lifts the tank 34, the weight of the tank 34 is distributed along the length of tube 12. If tank 34 is buried, it can be lifted with minimal excavation of the ground 38.

Depending on the size and weight of the tank 34, and on the number of access holes 36 in the tank 34, it may be necessary to employ more than one lifting apparatus 10. For example, a large tank having an access port at each end may require that a lifting apparatus 10 be inserted into each access port. The lifting rings 20 of each apparatus can be joined at hook 42. The length of cable 14 will depend on the type of equipment used to lift the tank, the size of the tank, and the number of apparatuses 10 used.

After tank 34 is in the desired location, the cable 14 is lowered, lessening the tension in the cable. Tube 12 pivots about contact point 19 and separates from the interior wall 37 of tank 34, returning to its vertical resting position. The weighting of the tube 12, forces cable 14 to again nestle into slot 28. The tube 12 can be easily removed from the interior of the tank.

The orientation of apparatus 10 is important to ensure that beveled end 26 properly engages the interior wall of tank 34 and that cable 14 interacts with slot 28 resulting in tubular body 12 turning around cable contact point 19. It should be noted that the weight of tube 12 against button 22 along with the frictional engagement of cable 14 along sloping legs 30, 32 resists the axial rotation of tube 12 around cable 14. Therefore, the crane operator can view and manually adjust, if necessary, the orientation of the apparatus 10 before it enters the access hole of tank 34. The crane operator can be assured that the apparatus will remain in that position after being lowered into the interior of tank 34. The crane operator will then know which side of upper wall 37 the first end 27 must engage.

The lowering of the tube 12 into the tank 34, the engagement of tube 12 with the interior wall 37 and subsequent pivoting motion of tube 12, and the release and removal of tube 12 from tank 34 are accomplished by the crane operator. No person is needed to enter the interior of the tank nor is a person needed to guide or situate the tube 12. Accordingly, the present invention increases safety at the job site and decreases the amount of time to lift and move a storage tank or similar object.

Even though particular embodiments of the present invention have been illustrated and described herein, it is not intended to limit the invention. It is understood that modification and variation of the present invention may be made without departing from the spirit or scope of the following claims.

I claim:

1. An apparatus for lifting objects, comprising:

(a) a substantially tubularly-shaped body, having a radial slot of generally uniform width extending axially from a first end of the body to substantially the lengthwise mid-point of the body and communicating with the hollow interior of the body;

(b) a cable having first and second ends and a maximum cross-section less than the narrowest section of the width of the slot, wherein the second end is at least partially threaded through the hollow interior of the body; and (c) a stop connected proximate to the second end of the cable, wherein the stop prevents the body from sliding off of the cable.

2. The apparatus of claim 1, wherein the first end of the body is beveled, the slot at least partially intersecting the beveled portion of the first end of the body.

3. The apparatus of claim 2, wherein the body is moveable from a resting position, substantially parallel to the cable such that a section of the cable is nestled within the slot and the hollow interior, to a lifting position wherein a portion of the nestled cable exits the body via the slot and the body is disposed substantially transverse to the first end of the cable.

4. The apparatus of claim 3, wherein the hollow interior of the body has a substantially "V" shape, when viewed from a longitudinal cross-section, the legs of the V-shaped hollow interior being substantially in the same plane defined by the length and depth of the slot.

5. The apparatus of claim 2 wherein the beveled portion is made in a plane substantially perpendicular to a plane defined by the length and depth of the slot and substantially at a 45° angle to the longitudinal axis of the body.

6. The apparatus of claim 2 wherein the second end of the cable is threaded completely through the hollow interior of the body.

7. The apparatus of claim 1, wherein the body is weighted so that the body tends to remain in a substantially vertical orientation when the apparatus is suspended by the cable.

8. The apparatus of claim 1, wherein the hollow interior of the body has a substantially "V" shape, as viewed from a longitudinal cross-section, the vertex of the "V" located substantially at a distance furthest away from the slot.

9. The apparatus of claim 8, wherein the first end of the body is beveled, the beveled edge overlapping the slot.

10. The apparatus of claim 9 wherein the second end of the cable is threaded completely through the hollow interior of the body.

11. The apparatus of claim 1 further comprising a connection means attached to the first end of the cable.

12. The apparatus of claim 11 wherein the connection means is a loop formed by wrapping the cable around a thimble and securing the first end of the cable with a swedge.

13. The apparatus of claim 1 wherein the second end of the cable is threaded completely through the hollow interior of the body.

14. A method of lifting objects having an access port located in an upper wall of the object, which comprises:

(a) suspending a substantially tubularly-shaped body from a cable threaded through the hollow interior of the body, the body having a length greater than the largest dimension of the access port;

(b) guiding the body into the access port;

(c) contacting the upper end of the body against an interior side of the upper wall of the object;

(d) retracting the cable from the access port so that the cable separates from the upper end of the body via a radial slot, the slot communicating with the hollow portion of the body and extending longitudinally from the first end of the body to substantially the lengthwise mid-point of the body, until the body pivots and at least the two ends of the body engage the interior side of the upper wall preventing the body from exiting through the access port; and (e) applying a force on the cable to lift the object.

15. The method of claim 14, wherein the body pivots substantially 90°.

16. An improved lifting apparatus of the type in which a lifting machine is releasably secured to an object having a portal by attaching the lifting apparatus to the lifting machine, inserting the lifting apparatus into the portal and moving the lifting apparatus from a resting position to a lifting position in order to lift the object, wherein the improvement comprises:

(a) a substantially cylindrically-shaped body having a hollow interior running the length of the body and a slot which extends from a first end of the body to approximately the lengthwise mid-point of the body, wherein the slot communicates with the hollow interior;

(b) a cable having a first end for attachment to the lifting machine and a second end which is passed into the first end of the body, and at least partially through the hollow interior past the mid-point of the body, and wherein the cable has a maximum cross-section less than the width of the slot; and (c) means for preventing the body from sliding off of the second end of the cable, said preventing means attaches proximate to the second end of the cable.

17. The improved lifting apparatus of claim 16, wherein the cable interacts with the body for moving the apparatus from the resting position in which the body is substantially coaxially located with the cable to the lifting position in which a portion of the cable exits the hollow interior of the body via the slot for disposing the body substantially transversely to the exited portion of cable.

18. The improved lifting apparatus of claim 17, wherein the first end of the body is beveled, the slot at least partially intersecting the beveled portion of the first end.

19. In a method of lifting and moving objects having a portal wherein a lifting machine lifts the object by introducing an apparatus into the portal, moving the apparatus from a resting position to a lifting position for releasably securing the object to the apparatus, and providing an upward force to the apparatus for lifting the object, the method comprising the steps of:

(a) attaching the apparatus to the lifting machine, by way of a first end of a cable;

(b) placing the apparatus in its resting position by suspending the apparatus from the lifting machine, wherein the cable runs through a tubularly-shaped body of the apparatus, the body having a body length greater than the maximum dimension of the portal but less than the length of the cable, the second end of the cable having a stop means for preventing the body from sliding off of the cable, wherein the body is weighted so that when the apparatus is suspended, the body is positioned substantially coaxially with the cable in a rest position, the upper end of the body having a beveled edge;

(c) lowering the body and at least a length of the cable into the portal; and (d) raising the cable out of the portal while catching the beveled edge of the body on an interior surface of the object, thereby moving the apparatus away from its rest position in which a portion of the cable exits the hollow interior of the body via a slot on the tube, the slot communicating with the hollow interior and extending longitudinally from the upper end of the body to approximately the lengthwise mid-point of the body, thereby terminating the movement of the apparatus in a lift position wherein the body is substantially transverse to the portion of the cable which exited the hollow interior and the ends of the body engage the interior of the object across the portal.

20. The method of claim 19 further comprising the steps of:

(e) moving the object to a desired location;

(f) lowering the apparatus until the object sits at the desired location and the ends of the body disengage the interior of the object, thereby returning the apparatus to its rest position; and (g) raising the body out of the portal.

* * * * *